US009939771B2

(12) United States Patent
Awano

(10) Patent No.: US 9,939,771 B2
(45) Date of Patent: Apr. 10, 2018

(54) RECORDING MATERIAL FOLD ENHANCING DEVICE, RECORDING MATERIAL STITCHING DEVICE, AND IMAGE FORMING SYSTEM

(71) Applicant: FUJI XEROX CO., LTD., Tokyo (JP)

(72) Inventor: Hiroaki Awano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 241 days.

(21) Appl. No.: 14/807,368

(22) Filed: Jul. 23, 2015

(65) Prior Publication Data

US 2016/0282791 A1 Sep. 29, 2016

(30) Foreign Application Priority Data

Mar. 26, 2015 (JP) ..... 2015-065214

(51) Int. Cl.

| | |
|---|---|
| ***B31F 1/00*** | (2006.01) |
| ***G03G 15/00*** | (2006.01) |
| ***B31F 1/10*** | (2006.01) |
| ***B42B 4/00*** | (2006.01) |
| ***B41L 43/12*** | (2006.01) |
| ***B65H 45/04*** | (2006.01) |
| ***B65H 45/12*** | (2006.01) |

(Continued)

(52) U.S. Cl.

CPC ..... *G03G 15/6538* (2013.01); *B31F 1/00* (2013.01); *B31F 1/0006* (2013.01); *B31F 1/0035* (2013.01); *B31F 1/10* (2013.01); *B41L 43/12* (2013.01); *B42B 2/00* (2013.01); *B42B 4/00* (2013.01); *B65H 45/04* (2013.01); *B65H 45/12* (2013.01); *B65H 45/18* (2013.01); *B65H 45/30* (2013.01); *G03G 15/6544* (2013.01); *B65H 2301/4505* (2013.01);

(Continued)

(58) Field of Classification Search

CPC ..... B41L 43/12; B31F 1/00; B31F 1/0006; B31F 1/0035; B65H 2301/4505; B65H 2801/27; B65H 45/04; B65H 45/12

USPC ..... 270/32, 45, 58.07, 58.08

See application file for complete search history.

(56) References Cited

U.S. PATENT DOCUMENTS 2,066,620 A * 1/1937 Grammer ..... B42B 4/00 281/27.3
5,520,604 A * 5/1996 Reist ..... B65H 45/30 493/422

(Continued)

FOREIGN PATENT DOCUMENTS

EP 2634125 A1 * 9/2013
EP 2644547 A1 * 10/2013

(Continued)

*Primary Examiner* — Leslie A Nicholson, III

(74) *Attorney, Agent, or Firm* — Sughrue Mion, PLLC

(57) ABSTRACT

A recording material fold enhancing device includes a pressing unit that includes one or more recessed portions and one or more protrusions, and that presses a fold of a recording material; a supporting unit that includes one or more recessed portions and one or more protrusions, and that supports the fold of the recording material; and a driving unit that moves the pressing unit and the supporting unit along a direction in which the fold of the recording material is formed. A portion of the fold of the recording material is interposed between the one or more recessed portions of the pressing unit and the one or more protrusions of the supporting unit, and another portion of the fold of the recording material is interposed between the one or more protrusions of the pressing unit and the one or more recessed portions of the supporting unit.

5 Claims, 9 Drawing Sheets

(51) Int. Cl.
*B42B 2/00* (2006.01)
*B65H 45/18* (2006.01)
*B65H 45/30* (2006.01)

(52) U.S. Cl.
CPC ..... *B65H 2301/51232* (2013.01); *B65H 2403/51* (2013.01); *B65H 2701/13212* (2013.01); *B65H 2801/27* (2013.01); *G03G 2215/00827* (2013.01); *G03G 2215/00831* (2013.01); *G03G 2215/00877* (2013.01)

(56) References Cited

U.S. PATENT DOCUMENTS 7,673,862 B2 * 3/2010 Kushida ..... B65H 37/06 270/20.1
8,123,447 B2 * 2/2012 Richter ..... B42C 1/12 412/1
8,459,630 B2 * 6/2013 Watanabe ..... B65H 45/18 270/32
8,500,111 B2 * 8/2013 Terao ..... B65H 45/18 270/32
2012/0190526 A1 7/2012 Terao
2013/0231234 A1 * 9/2013 Oudsen ..... B31F 1/0003 493/405
2013/0252795 A1 * 9/2013 Oudsen ..... B65H 45/16 493/454
2014/0206519 A1 7/2014 Hoshino et al.

FOREIGN PATENT DOCUMENTS

JP 2012-153530 A 8/2012
JP 2014-185033 A 10/2014

* cited by examiner

RECORDING MATERIAL FOLD ENHANCING DEVICE, RECORDING MATERIAL STITCHING DEVICE, AND IMAGE FORMING SYSTEM

CROSS-REFERENCE TO RELATED APPLICATIONS

This application is based on and claims priority under 35 USC 119 from Japanese Patent Application No. 2015-065214 filed Mar. 26, 2015.

BACKGROUND

Technical Field

The present invention relates to a recording material fold enhancing device, a recording material stitching device, and an image forming system.

SUMMARY

According to an aspect of the invention, there is provided a recording material fold enhancing device including a pressing unit that includes one or more recessed portions and one or more protrusions, the pressing unit pressing a fold of a recording material on which a folding operation has been performed; a supporting unit that includes one or more recessed portions and one or more protrusions, the supporting unit supporting the fold of the recording material with the fold of the recording material being interposed between the pressing unit and the supporting unit; and a driving unit that, with the fold of the recording material being interposed between the pressing unit and the supporting unit, moves the pressing unit and the supporting unit along a direction in which the fold of the recording material is formed. In the recording material fold enhancing device, a portion of the fold of the recording material is interposed between the one or more recessed portions of the pressing unit and the one or more protrusions of the supporting unit, and another portion of the fold of the recording material is interposed between the one or more protrusions of the pressing unit and the one or more recessed portions of the supporting unit.

BRIEF DESCRIPTION OF THE DRAWINGS

An exemplary embodiment of the present invention will be described in detail based on the following figures, wherein.

DETAILED DESCRIPTION

Description of Image Forming System 1

Figure 1:
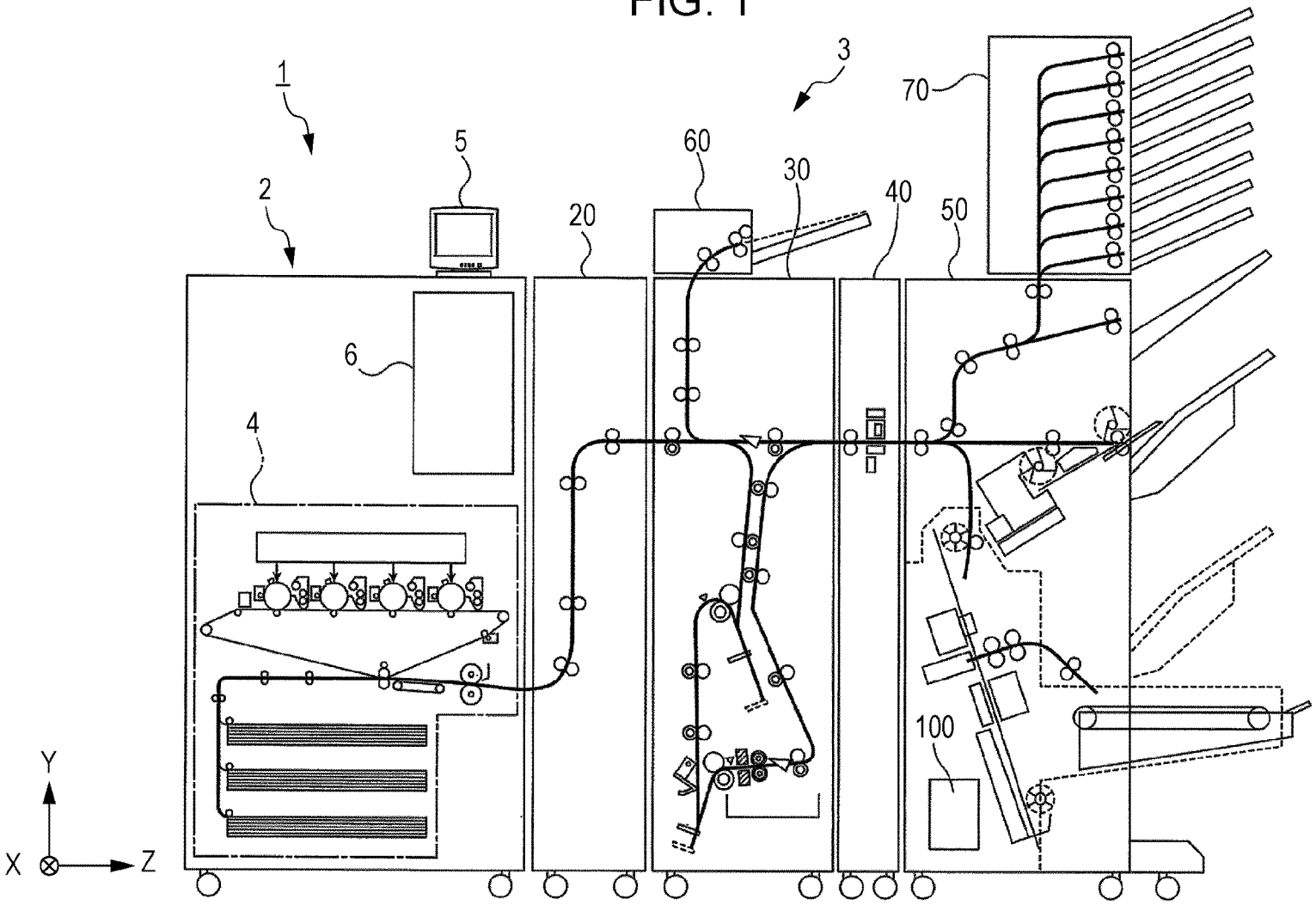
FIG. 1 illustrates an exemplary overall structure of an image forming system to which an exemplary embodiment is applied.

An exemplary embodiment of the present invention is hereunder described in detail with reference to the attached drawings. FIG. 1 illustrates an exemplary overall structure of an image forming system 1 to which the exemplary embodiment is applied. FIG. 1 is a front view of the image forming system 1 when viewed from a front F where a user is allowed to give instructions or perform operations. The image forming system 1 illustrated in FIG. 1 includes an image forming apparatus 2 and a sheet processing apparatus 3. The image forming apparatus 2 is, for example, a printer or a copying machine, which forms a color image by, for example, an electrophotographic system. The image processing apparatus 3 performs postprocessing on a sheet, which serves as an exemplary recording material, on which a toner image or the like has been formed by the image forming apparatus 2.

The image forming apparatus 2 is, for example, what is called a tandem image forming apparatus. The image forming apparatus 2 includes an image forming unit 4, an operation input unit 5, and a main controller 6. The image forming unit 4 forms an image on the basis of image data for each color. The operation input unit 5 allows input of an operation by a user. The main controller 6 controls the operation of the image forming apparatus 2 and the operation of the entire image forming system 1.

In the following description, in the image forming system 1, a direction from the front F to a rear R is called a direction X, a direction from a lower side to an upper side is called a direction Y, and a direction crossing the direction X and the direction Y and from left to right when viewed from the front F is called a direction Z.

Figure 2:
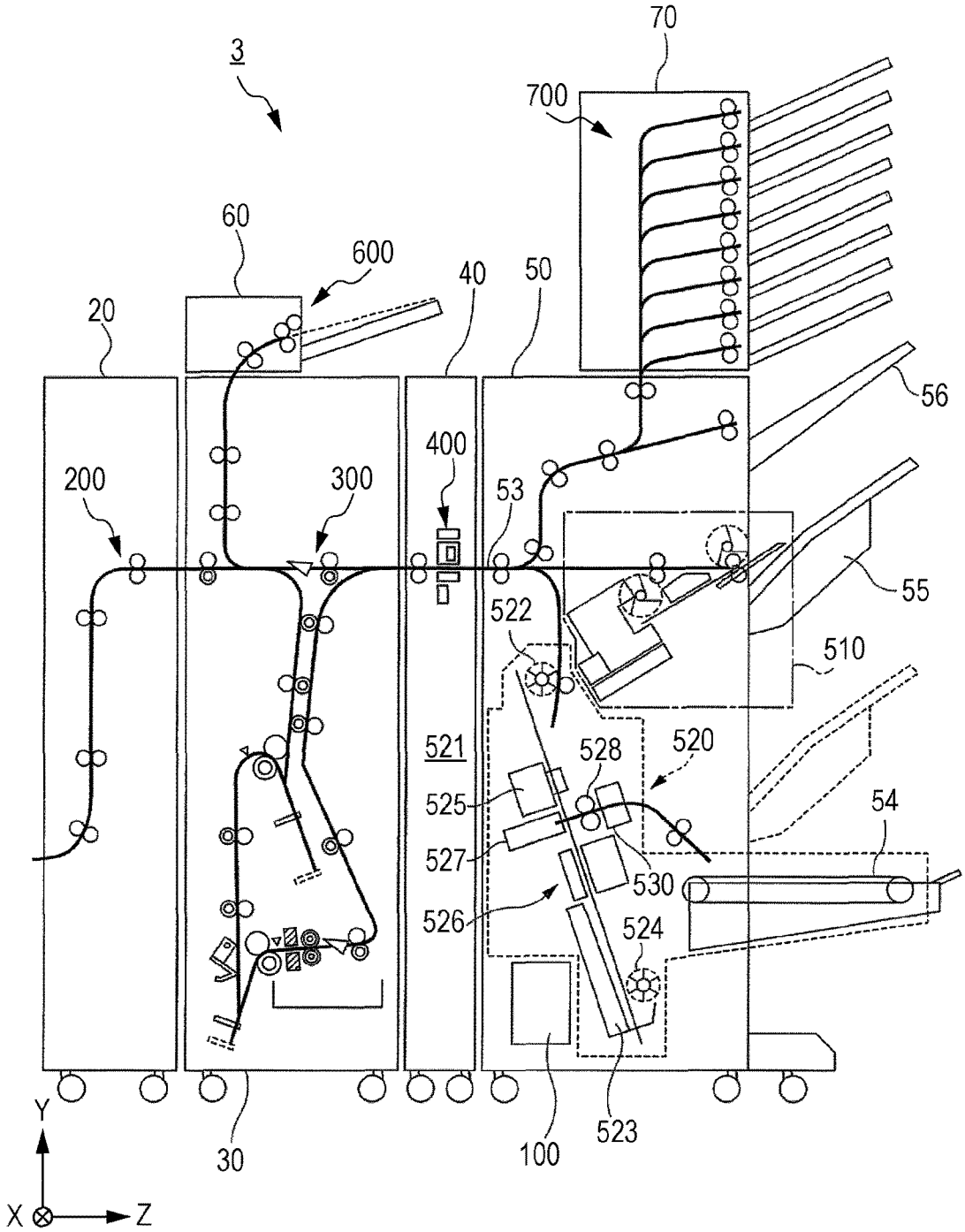
FIG. 2 is a perspective view of a structure of a sheet processing apparatus.

FIG. 2 illustrates a structure of the sheet processing apparatus 3.

As illustrated in FIGS. 1 and 2, the sheet processing apparatus 3 includes a transporting device 20 that includes a transport functional unit 200 that transports a sheet output from the image forming apparatus 2 further downstream. The sheet processing apparatus 3 also includes a folding device 30 that includes a folding functional unit 300 that folds (for example, performs C folding or Z folding on) the sheet transported from the transporting device 20. The sheet processing apparatus 3 further includes a perforating device 40 that is disposed downstream from the folding device 30 and that includes a perforating functional unit 400 that forms holes in the sheet transported from the folding device 30. The sheet processing apparatus 3 still further includes a stitching bookbinding device 50 that is disposed downstream from the perforating device 40 and that includes an end stitching functional unit 510, a bookbinding functional unit 520, and a fold enhancing functional unit 530. The end stitching functional unit 510 stitches ends of sheets. The bookbinding functional unit 520 performs bookbinding. The fold enhancing functional unit 530 enhances a fold of printed material S, which serves as an exemplary recording material sheaf, on which the bookbinding operation has been performed.

The sheet processing apparatus 3 still further includes an insertion device 60 and a sorting device 70. The insertion device 60 includes an insertion functional unit 600 that inserts an inserting sheet, such as a thick sheet or a windowed sheet, between the sheets that are transported to the folding device 30. The sorting functional unit 700 sorts the sheets transported from the stitching bookbinding device 50 to discharge the sorted sheets to corresponding trays.

The sheet processing apparatus 3 still further includes a sheet processing controller 100 that controls the entire sheet processing apparatus 3. In this exemplary embodiment, the sheet processing controller 100 is provided in the stitching bookbinding device 50.

Here, in the sheet processing apparatus 3 of the image forming system 1 according to the exemplary embodiment, a sheet discharge opening of the transporting device 20, a sheet discharge opening of the folding device 30, and a sheet discharge opening of the perforating device 40 are set at the same height. In addition, in the sheet processing apparatus 3, a sheet insertion opening of the folding device 30, a sheet insertion opening of the perforating device 40, and a sheet insertion opening of the stitching bookbinding device 50 are set at the same height. Further, in the sheet processing apparatus 3 according to the exemplary embodiment, the transporting device 20, the folding device 30, the perforating device 40, and the stitching bookbinding device 50 include a common interface for transporting sheets.

Still further, in the sheet processing apparatus 3 according to the exemplary embodiment, the transporting device 20, the folding device 30, the perforating device 40, and the stitching bookbinding device 50 include a common interface for electrical connection and mechanical connection.

Accordingly, in the sheet processing apparatus 3, it is possible to change the order of connection of each device (such as the folding device 30, the perforating device 40, and the stitching bookbinding device 50) or a combination of devices to be connected.

Description of Stitching Bookbinding Device

Next, a structure of the stitching bookbinding device 50 according to the exemplary embodiment is described.

As mentioned above, the stitching bookbinding device 50, which serves as an exemplary recording material stitching device, includes the end stitching functional unit 510 for stitching ends of a sheet sheaf, the bookbinding functional unit 520 that forms a printed material S spread by center-folding the sheet sheaf/by saddle-stitching the sheet sheaf. The fold enhancing functional unit 530 enhances a fold of the printed material S formed by center-folding the printed material S. In addition, the stitching bookbinding device 50 includes a send-in opening 53 that receives the sheets transported from the perforating device 40 and hold trays 54 to 56 that hold the sheets processed by the stitching bookbinding device 50.

Description of Bookbinding Functional Unit

Next, the bookbinding functional unit 520 of the stitching bookbinding device 50 is described.

As shown in FIG. 2, the bookbinding functional unit 520 includes a sheet accumulation unit 521, a discharge roller 522, and an end guide 523. The sheet accumulation unit 521 serves as an exemplary recording material stacking unit where only a required number of sheets after image formation are accumulated. The discharge roller 522 discharges the sheets to the sheet accumulation unit 521. The end guide 523 moves along the sheet accumulation unit 521 for determining a saddle-stitch position or a center-folding position. In addition, the bookbinding functional unit 520 includes sheet aligning members 524 that transport the sheets accumulated at the sheet accumulation unit 521 towards the end guide 523.

The bookbinding functional unit 520 also includes a sheet widthwise aligning member 525 and a stapler 526. The sheet widthwise aligning member 525 includes a pair of aligning plates that slide for aligning in a width direction the sheets accumulated at the sheet accumulation unit 521. The stapler 526 serves as an exemplary stitching unit that performs saddle-stitching on a sheet sheaf provided in the sheet accumulation unit 521. Further, the bookbinding functional unit 520 includes a folding knife 527 and a folding roller 528. The folding knife 527 serves as an exemplary folding unit that moves so as to protrude from a lower side towards an upper side of the sheet accumulation unit 521 for folding at a saddle-stitch position the sheet sheaf that has been saddle-stitched by the stapler 526. The folding roller 528 includes a pair of rollers that nip the sheet sheaf on which the folding operation by the folding knife 527 has been started. Of portions of the sheet accumulation unit 521, the portion thereof opposing the folding knife 527 has an opening (not shown).

When a center-folded/saddle-stitched printed material S is to be formed by the stitching bookbinding device 50, on the basis of an instruction from the sheet processing controller 100, a sheet that has been transported via the transporting device 20, the folding device 30, and the perforating device 40 is sent to the bookbinding functional unit 520. Then, the discharge roller 522 of the bookbinding functional unit 520 sends out to the sheet accumulation unit 521 the sheet that is being transported. This causes, for example, the number of sheets set by the main controller 6 (see FIG. 1) of the image forming apparatus 2, such as 5 sheets, 10 sheets, or 15 sheets, to be accumulated at the sheet accumulation unit 521. At this time, the end guide 523 moves and stops so that, for example, a central portion of each sheet in a transport direction corresponds to a staple position where the stapler 526 staples each sheet. Further, at this time, the sheet aligning members 524 rotate and push the accumulated sheets against the end guide 523, to help align the sheets. The sheet widthwise aligning member 525 slides in a width direction of the sheets that are accumulated at the sheet accumulation unit 521, and aligns the accumulated sheets from the width direction.

After a predetermined number of sheets have been accumulated at the sheet accumulation unit 521, the stapler 526 performs saddle-stitching on part of each sheet (such as the central portion thereof in the transport direction).

Next, a sheet sheaf formed after the saddle-stitching has been completed is moved so that, by an upward movement of the end guide 523, a fold (such as the central portion of each sheet in the transport direction) is aligned with the position of an end of the folding knife 527. The folding knife 527 is formed so that its end withdraws to a lower portion of the sheet accumulation unit 521 when sheets are being accumulated at the sheet accumulation unit 521, when sheets are being saddle-stitched by the stapler 526, or when sheets are being transported after having been saddle-stitched.

After having moved the folding position of the sheet sheaf to the position of the end of the folding knife 527, a DC motor (not shown) causes the folding knife 527 to be pushed from the lower side to the upper side. That is, the end of the folding knife 527 presses the sheet sheaf from the lower side to the upper side along a direction that crosses an accumulation surface of the sheet accumulation unit 521 having the opening at the position opposing the folding knife 527. Then, the end of the folding knife 527 is pushed towards an upper side of the opening of the sheet accumulation unit 521. This causes the sheet sheaf to be pushed upward from the accumulation surface of the sheet accumulation unit 521, and to be nipped by the folding rollers 528. In this case, the folding knife 527 moves up to a location where the sheet sheaf is driven into the folding rollers 528.

This causes the printed material S formed from the predetermined number of sheets accumulated at the sheet accumulation unit 521 to be pushed by the folding knife 527 and nipped between the folding rollers 528, as a result of which the printed material S is subjected to center-folding.

Description of Fold Enhancing Functional Unit

Next, the fold enhancing functional unit 530 of the stitching bookbinding device 50 is described.

Figure 3:
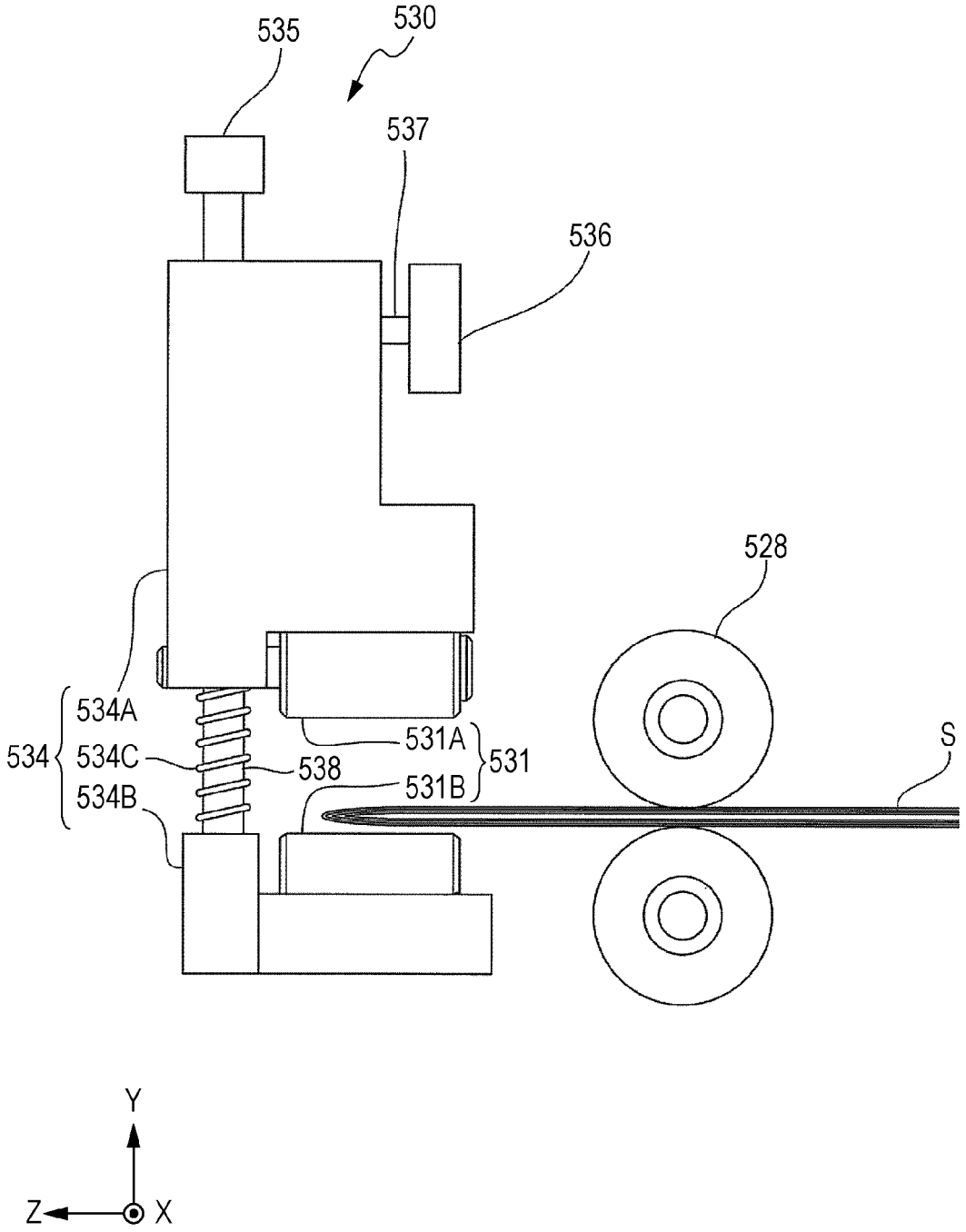
FIG. 3 is a front view of a structure of a fold enhancing functional unit.

FIG. 3 illustrates a structure of the fold enhancing functional unit 530, and is a front view of the fold enhancing functional unit 530 when viewed from the front F.

As illustrated in FIG. 3, the fold enhancing functional unit 530 includes a fold enhancing roller unit 531 and a supporting member 534. The fold enhancing roller unit 531 performs fold enhancement by nipping a fold of printed material S that is supported by the folding rollers 528. The supporting member 534 supports the fold enhancing roller unit 531. The fold enhancing functional unit 530 also includes a movement mechanical unit 535 and a path guide unit 536. The movement mechanical unit 535 causes the fold enhancing functional unit 530 to move. The path guide unit 536 guides the fold enhancing functional unit 530 along a path in which the fold enhancing functional unit 530 is to move. The fold enhancing functional unit 530 further includes a cam 537 and a supporting shaft 538. The cam 537 is connected to the supporting member 534 and is fitted to the path guide unit 536. The supporting shaft 538 supports the supporting member 534 and the movement mechanical unit 535 as a shaft.

The fold enhancing roller unit 531 includes an upper roller 531A and a lower roller 531B. The upper roller 531A presses the printed material S from an upper side of the printed material S. The lower roller 531B supports the printed patter S from a lower side of the printed material S. The upper roller 531A is provided so as to be movable vertically. By nipping and pressing the fold of the printed material S between the upper roller 531A and the lower roller 531B, fold enhancement is performed on the fold of the printed material S. A detailed structure of the fold enhancing roller unit 531 is described below.

The supporting member 534 includes an upper supporting unit 534A, a lower supporting unit 534B, and a spring 534C. The upper supporting unit 534A supports the upper roller 531A. The lower supporting unit 534B supports the lower roller 531B. The spring 534C is provided between the upper supporting unit 534A and the lower supporting unit 534B. The upper supporting unit 534A is provided so as receive the supporting shaft 538 in the entire supporting unit 534A, and so as to be movable along the supporting shaft 538. The lower supporting unit 534B is provided so as to be connected to a lower end portion of the supporting shaft 538. The spring 534C is provided between the upper supporting unit 534A and the lower supporting unit 534B so as to receive the supporting shaft 538 in the entire spring 534C, and suppresses movement of the upper supporting unit 534A along the supporting shaft 538 towards the lower supporting unit 534B.

The movement mechanical unit 535, which serves as an exemplary driving unit, is provided so as to be connected to an upper end of the supporting shaft 538. A motor (not shown) causes the fold enhancing functional unit 530 to move along a direction in which the fold of the printed material S that is supported by the folding rollers 528 is formed. When fold enhancement is not performed on the printed material S, the fold enhancing functional unit 530 is in a standby state at a front-F-side end portion of the stitching bookbinding device 50, and does not interfere with the transport of the printed material S that is being transported by the folding rollers 528.

The path guide unit 536 includes a movement path section that forms movement paths of the cam 537 when the fold enhancing functional unit 530 moves. A detailed structure of the movement path section 540 is described below.

The cam 537 is provided so as to be connected to the upper supporting unit 534A and so that a portion of the cam 537 is fitted to the movement path section 540 of the path guide unit 536. When the fold enhancing functional unit 530 moves, the cam 537 moves vertically along the path of the movement path section 540. When the cam 537 moves downward, the upper supporting unit 534A that is connected to the cam 537 is pushed, and moves along the supporting shaft 538 so as to approach the lower supporting unit 534B via the spring 534C.

The supporting shaft 538 is provide so as to extend downward from a connection portion where the supporting shaft 538 is connected to the movement mechanical unit 535, and extend through the supporting unit 534A and the spring 534C in that order from an upper side, with the lower end of the supporting shaft 538 being connected to the lower supporting unit 534B.

Description of Fold Enhancement of Printed Material Performed by Fold Enhancing Functional Unit Next, fold enhancement on printed material S that is performed by the fold enhancing functional unit 530 is described.

Figure 4:
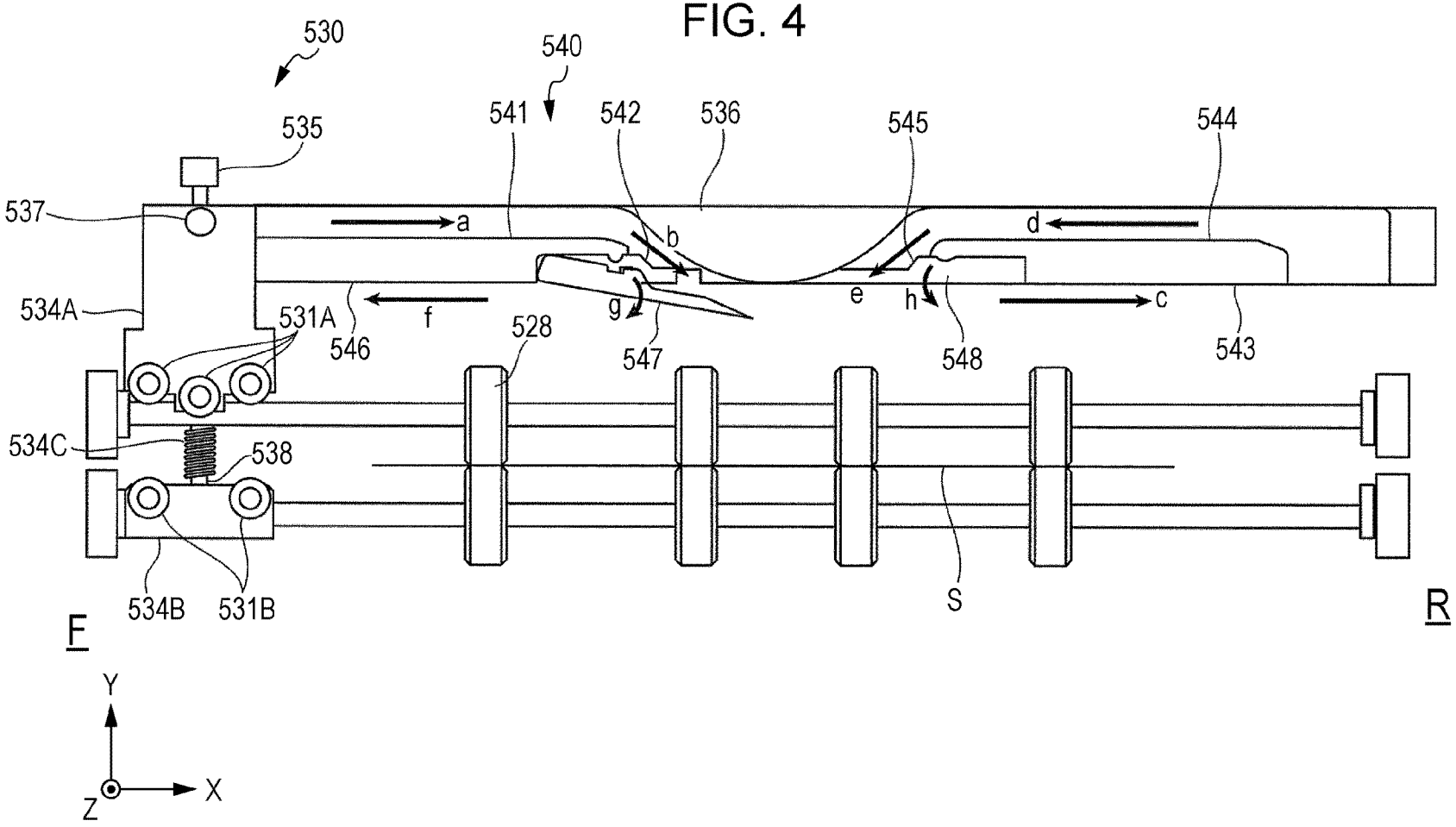
FIG. 4 is a side view of the structure of the fold enhancing functional unit.

FIG. 4 illustrates a structure of the fold enhancing functional unit 530, and is a side view of the fold enhancing functional unit 530.

As mentioned above, by driving force from the movement mechanical unit 535, the fold enhancing functional unit 530 moves from the front-F-side end portion of the stitching bookbinding device 50, which corresponds to a standby position, along the direction in which a fold of the printed material S that is supported by the folding rollers 528 is formed (the direction X in FIG. 4). At this time, the cam 537 moves vertically with respect to the fold enhancing functional unit 530 along the movement path section 540.

The movement path section 540 includes a first movement path 541, a second movement path 542, and a third movement path 543. The first movement path 541 is provided so as to extend in the direction X from the front-F-side end portion of the stitching bookbinding device 50 to a location that is situated at a near side of a central portion of the stitching bookbinding device 50. The second movement path 542 is provided so as to extend in the direction X from a terminal end of the first movement path 541 to a location beyond the central portion of the stitching bookbinding device 50 and so as to tilt downward (in a direction −Y in FIG. 4). The third movement path 543 is provided so as to extend in the direction X from a terminal end of the second movement path 542 to a rear-R-side end portion of the stitching bookbinding device 50.

The movement path section 540 also includes a fourth movement path 544, a fifth movement path 545, and a sixth movement path 546. The fourth movement path 544 is provided so as to extend in a direction −X from the rear-R-side end portion of the stitching bookbinding device 50 to a location that is situated at a near side of the central portion of the stitching bookbinding device 50, and is provided above the third movement path 543. The fifth movement path 545 is provided so as to extend in the direction −X from a terminal end of the fourth movement path 544 to a location beyond the central portion of the stitching bookbinding device 50, and so as to tilt downward (in the direction −Y in FIG. 4). The sixth movement path 546 is provided so as to extend in the direction −X from a terminal end of the fifth movement path 545 to the front-F-side end portion of the stitching bookbinding device 50, and is provided below the first movement path 541.

The movement path section 540 further includes a first path switching unit 547 that is provided between the second movement path 542 and the third movement path 543 so as to be capable of moving out of the second movement path 542 and the third movement path 543. The movement path section 540 still further includes a second path switching unit 548 that is provided between the fourth movement path 544 and the fifth movement path 545 so as to be capable of moving out of the fourth movement path 544 and the fifth movement path 545.

The first path switching unit 547 withdraws in the direction of arrow g in FIG. 4 by a push force from the second movement path 542 situated above the first path switching unit 547. This causes the second movement path 542 and the third movement path 543 to be connected to each other. On the other hand, the first path switching unit 547 does not withdraw by a push force from the sixth movement path 546 that is situated below the first path switching unit 547, as a result of which the sixth movement path 546 and the second movement path 542 are not connected to each other.

The second path switching unit 548 withdraws in the direction of arrow h in FIG. 4 by a push force from the fourth movement path 544 that is situated above the second path switching unit 548. This causes the fourth movement path 544 and the fifth movement path 545 to be connected to each other. On the other hand, the second path switching unit 548 does not withdraw by a push force from the third movement path 543 that is situated below the second path switching unit 548.

In performing fold enhancement on the printed material S, when the printed material S transported by the folding rollers 528 reaches the fold enhancing functional unit 530, the fold enhancing functional unit 530 starts moving from the front-F-side end portion of the stitching bookbinding device 50 on the basis of an instruction from the sheet processing controller 100. This allows the first movement path 541 to guide the cam 537 in the direction of arrow a in FIG. 4. At this time, the fold enhancing functional unit 530 moves in the direction X with the printed material S supported by the folding rollers 528 being positioned between the upper roller 531A and the lower roller 531B. The upper roller 531A is separated from the lower roller 531B. Therefore, the printed material S is either in a state in which it does not contact the fold enhancing roller unit 531 or in a state in which it contacts the fold enhancing roller unit 531 without being pressed.

The second movement path 542 guides the cam 537 in the direction of arrow b. When the first path switching unit 547 that is provided between the second movement path 542 and the third movement path 543 contacts and is pushed by the cam 537 that moves in the second movement path 542, the first path switching unit 547 withdraws in the direction of arrow g in FIG. 4, and guides the cam 537 to the third movement path 543. The cam 537 that moves along the second movement path 542 moves downward while moving in the direction X. This causes the upper supporting unit 534A to be pushed by the cam 537 and to move downward with respect to the supporting shaft 538. This causes, at a location situated closer to the front F than the central portion of the stitching bookbinding device 50, the upper roller 531A that is supported by the upper supporting unit 534A to approach the lower roller 531B, after which the fold of the printed material S is nipped and pressed between the upper roller 531A and the lower roller 531B.

Thereafter, the cam 537 moves along the third movement path 543 in the direction of arrow c shown in FIG. 4. With the fold enhancing roller unit 531 pressing the fold of the printed material S, the fold enhancing functional unit 530 moves to the rear-R-side end portion of the stitching bookbinding device 50. This causes fold enhancement to be performed on a portion of the fold of the printed material S that is closer to the rear R than the central portion thereof in the width direction. Though the second path switching unit 548 is provided above the third movement path 543, the second path switching unit 548 does not withdraw by a push force from below the second path switching unit 548. Therefore, the cam 537 does not move to the fourth movement path 544 from the third movement path 543 via the second path switching unit 548.

When the fold enhancing functional unit 530 moves beyond the third movement path 543 and reaches the rear-R-side end portion of the stitching bookbinding device 50, the application of push force of the cam 537 from the third movement path 543 is stopped. This causes the upper supporting unit 534A that is subjected to a push force from below the upper supporting unit 534A by the spring 534C to move upward with respect to the supporting shaft 538. This causes the cam 537 to also move upward and to stop at the height of the fourth movement path 544. By this, the upper roller 531A moves upward and away from the printed material S, as a result of which the application of push force on the fold of the printed material S by the fold enhancing roller unit 531 is stopped.

The fold enhancing functional unit 530 that has reached the rear-R-side end portion of the stitching bookbinding device 50 starts to subsequently move in the direction −X. The fourth movement path 544 guides the cam 537 in the direction of arrow d in FIG. 4. At this time, the upper roller 531A is separated from the lower roller 531B, so that the printed material S is either in a state in which it does not contact the fold enhancing roller unit 531 or in a state in which it contacts the fold enhancing roller unit 531 without being pressed.

The fifth movement path 545 guides the cam 537 in the direction of arrow e in FIG. 4. When the second path switching unit 548 that is provided between the fifth movement path 545 and the sixth movement path 546 contacts and is pushed by the cam 537 that moves in the fifth movement path 545, the second path switching unit 548 withdraws in the direction of arrow h in FIG. 4, and guides the cam 537 to the sixth movement path 546. The cam 537 that moves along the fifth movement path 545 moves downward while moving in the direction −X. This causes the upper supporting unit 534A that is connected to the cam 537 to move downward with respect to the supporting shaft 538. This causes, at a location situated closer to the rear R than the central portion of the stitching bookbinding device 50, the upper roller 531A to approach the lower roller 531B, after which the fold of the printed material S is nipped and pressed between the upper roller 531A and the lower roller 531B.

Thereafter, the cam 537 moves along the sixth movement path 546 in the direction of arrow f shown in FIG. 4. With the fold enhancing roller unit 531 pressing the fold of the printed material S, the fold enhancing functional unit 530 moves to the front-F-side end portion of the stitching bookbinding device 50. This causes fold enhancement to be performed on a portion of the fold of the printed material S that is closer to the front F than the central portion thereof in the width direction. Though the first path switching unit 547 is provided above the sixth movement path 546, the first path switching unit 547 does not withdraw by a push force from below the first path switching unit 547. Therefore, the cam 537 does not move to the first movement path 541 from the sixth movement path 546 via the first path switching unit 547.

When the fold enhancing functional unit 530 moves beyond the sixth movement path 546 and reaches the front-F-side end portion of the stitching bookbinding device 50, the application of push force of the cam 537 from the sixth movement path 546 is stopped. This causes the upper supporting unit 534A that is subjected to a push force from below the upper supporting unit 534A by the spring 534C to move upward with respect to the supporting shaft 538. This causes the cam 537 to also move upward and to stop at the height of the first movement path 541. By this, the upper roller 531A moves upward and away from the printed material S, as a result of which the application of push force on the fold of the printed material S by the fold enhancing roller unit 531 is stopped.

By the above-described operations, the fold enhancement performed on the fold of the printed material S by the fold enhancing functional unit 530 is completed.

Description of a Structure of the Fold Enhancing Roller Unit

Figure 5:
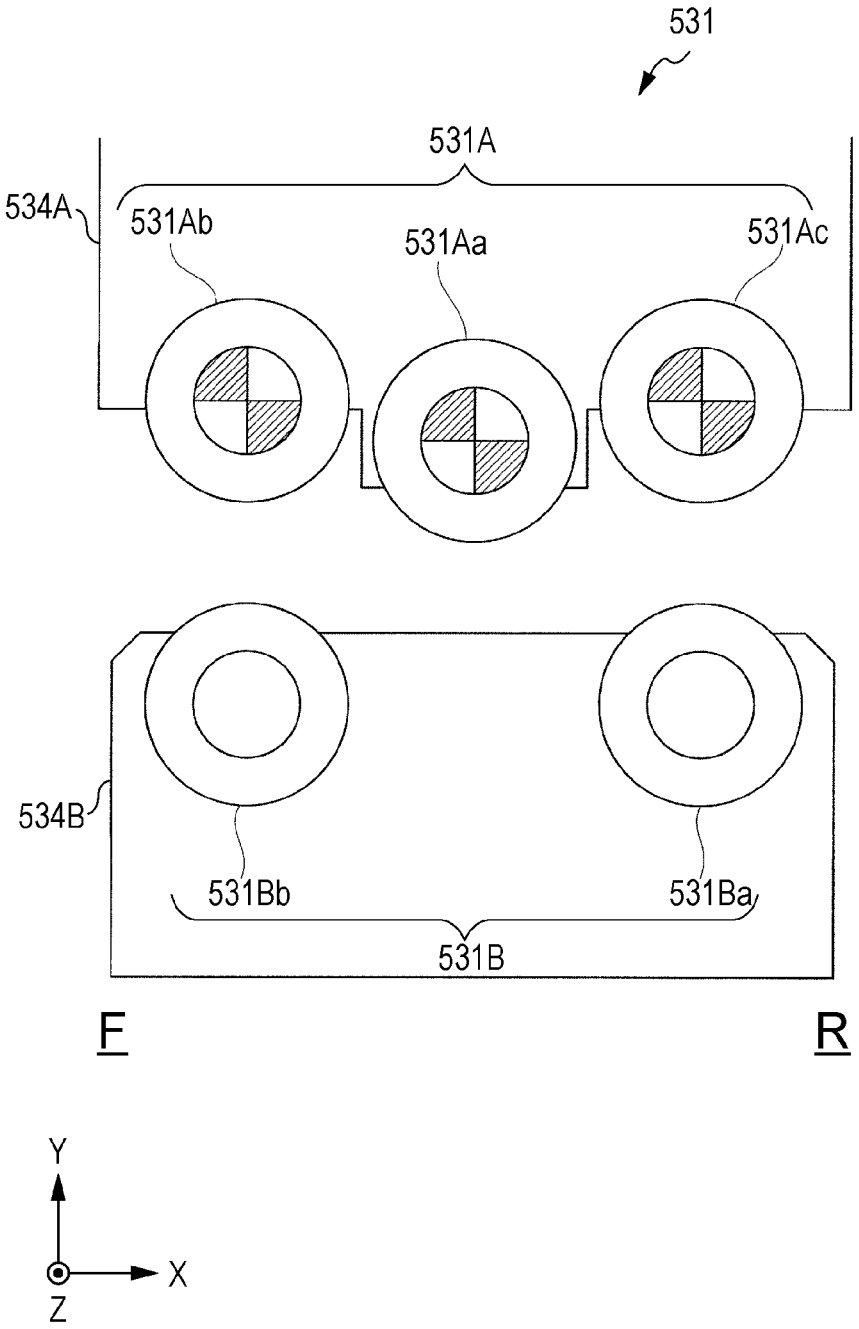
FIG. 5 is a front view of an exemplary structure of a fold enhancing roller unit.

Next, a structure of the fold enhancing roller unit 531 is described. FIG. 5 illustrates a functional structure of the fold enhancing roller unit 531 to which the exemplary embodiment is applied.

Of the rollers of the fold enhancing roller unit 531, the upper roller 531A, which serves as an exemplary pressing unit, includes an upper roller 531Aa, an upper roller 531Ab, and an upper roller 531Ac. The upper roller 531Ab is provided closer to the front F than the upper roller 531Aa. The upper roller 531Ac is provided closer to the rear R than the upper roller 531Aa.

Of the rollers of the fold enhancing roller unit 531, the lower roller 531B, which serves as an exemplary supporting unit, includes a lower roller 531Ba and a lower roller 531Bb. The lower roller 531Ba is provided closer to the rear R than the upper roller 531Aa. The lower roller 531Bb is provided closer to the front F than the lower roller 531Ba.

The upper roller 531Aa, the upper roller 531Ab, and the upper roller 531Ac are each supported by the upper supporting unit 534A. The upper roller 531Aa is supported so as to protrude downward with respect to the upper roller 531Ab and the upper roller 531Ac. The upper roller 531Ab and the upper roller 531Ac are supported at the same height. The lower roller 531Ba and the lower roller 531Bb are each supported at the same height by the lower supporting unit 534B. The upper roller 531Ac and the lower roller 531Ba are provided such that their positions in the directions of movement of the fold enhancing functional unit 530 (that is, the directions X and −X) are aligned with each other. The upper roller 531Ab and the lower roller 531Bb are provided such that their positions in the directions of movement of the fold enhancing functional unit 530 are aligned with each other.

The upper roller 531Aa is an exemplary first pressing roller. The upper roller 531Ab is an exemplary second pressing roller. The upper roller 531Ac is an exemplary third pressing roller. The lower roller 531Bb is an exemplary first supporting roller. The lower roller 531Ba is an exemplary second supporting roller.

Figure 6A:
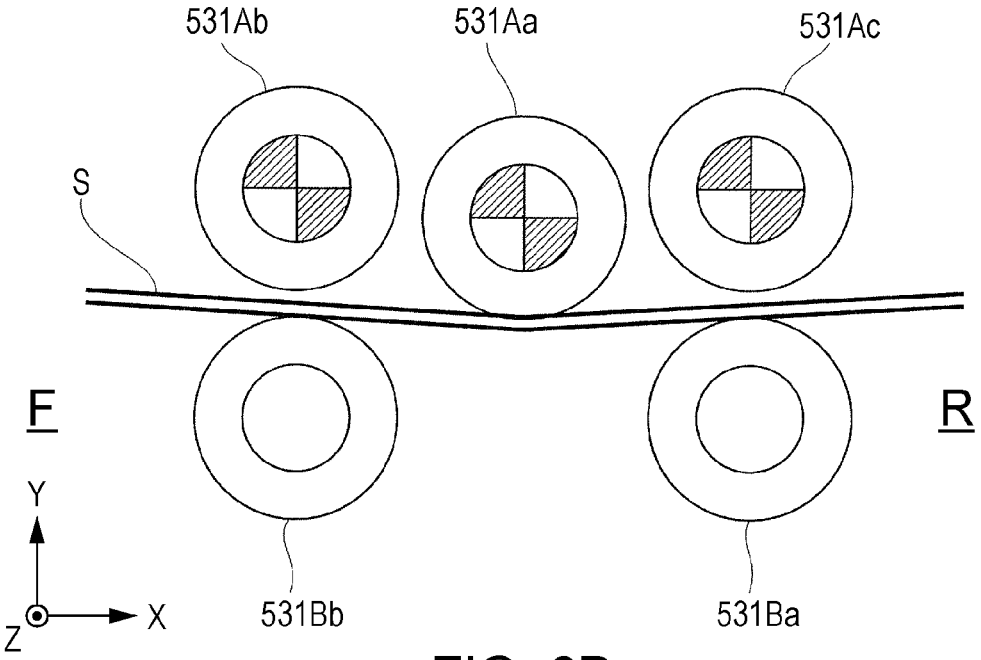
FIG. 6A illustrates a state in which part of the upper roller is in contact with printed material.
Figure 6B:
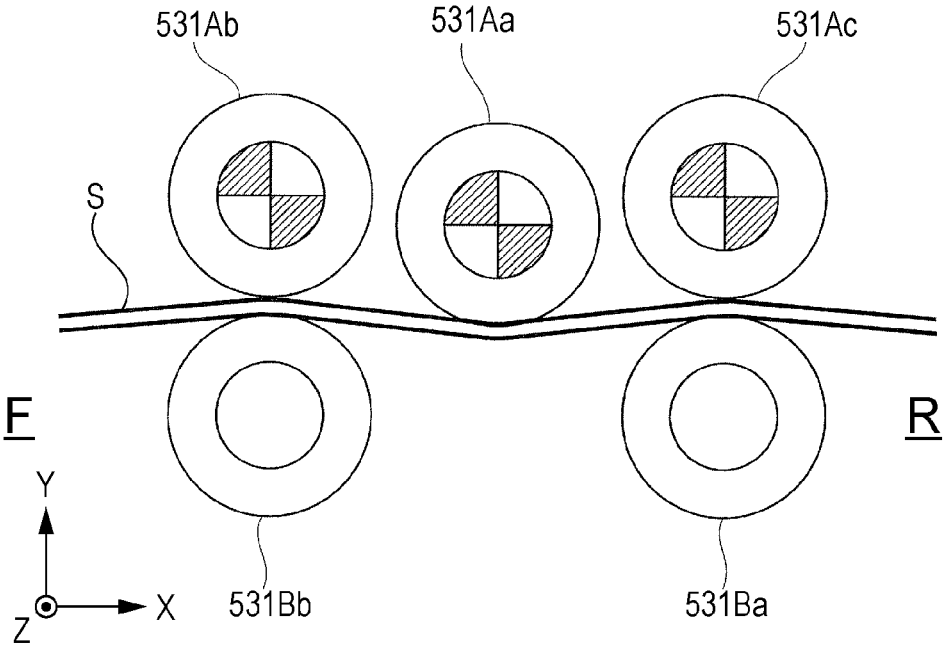
FIG. 6B illustrates a state of the printed material when the printed material is subjected to fold enhancement by the fold enhancing roller unit.

Description of States of Printed Material that is Pressed by Fold Enhancing Roller Unit Next, states of printed material S that is pressed by the fold enhancing roller unit 531 is described. FIG. 6A illustrates the state in which part of the upper roller 531A is in contact with the printed material S. FIG. 6B illustrates the state of the printed material S when the printed material S is subjected to fold enhancement by the fold enhancing roller unit 531.

When the upper roller 531A moves downward towards the lower roller 531B, the upper roller 531Aa first contacts the printed material S. By this, as shown in FIG. 6A, of an upper surface of the printed material S, a portion thereof that contacts the upper roller 531Aa is wound upon the upper roller 531Aa. From this state, the upper roller 531A moves downward towards the lower roller 531B. As shown in FIG. 6B, this causes the upper roller 531Ac to contact the printed material S, as a result of which a fold of the printed material S is nipped and pressed between the upper roller 531Ac and the lower roller 531Ba. The upper roller 531Ab also contacts the printed material S, as a result of which the fold of the printed material S is nipped and pressed between the upper roller 531Ab and the lower roller 531Bb.

In the state shown in FIG. 6B, the upper surface of the printed material S is wound upon the upper roller 531Aa, and a lower surface of the printed material S is wound upon the lower roller 531Ba and the lower roller 531Bb. In the exemplary embodiment, in the upper roller 531A, the upper roller 531Aa forms a protrusion, and the upper roller 531Ab and the upper roller 531Ac form recessed portions. In the lower roller 531B, the lower roller 531Ba and the lower roller 531Bb form protrusions, with a gap formed between the lower roller 531Ba and the lower roller 531Bb forming a recessed portion. The upper roller 531Ac, which forms a recessed portion, and the lower roller 531Ba, which forms a protrusion, engage with each other. The upper roller 531Ab, which forms a recessed portion, and the lower roller 531Bb, which forms a protrusion, engage with each other. The gap that forms a recessed portion and that is formed between the lower roller 531Ba and the lower roller 531Bb engages with the upper roller 531Aa, which forms a protrusion.

In this way, in the exemplary embodiment, the recessed portions and protrusion of the upper roller 531A and the recessed portion and protrusions of the lower roller 531B engage with each other with the fold of the printed material S being interposed therebetween, so that the fold of the printed material S is wound upon the protrusion of the upper roller 531Aa, the protrusion of the lower roller 531Ba, and the protrusion of the lower roller 531Bb. In this state, the fold enhancing functional unit 530 moves along the direction in which the fold of the printed material S is formed, so that the fold of the printed material S is drawn through the fold enhancing roller unit 531. Even if the printed material S is formed from sheets having high rigidity or is formed from many sheets, the printed material S is capable of being subjected to sufficient fold enhancement.

Description of Another Exemplary Structure of Fold Enhancing Roller Unit

In the exemplary embodiment, the case in which the recessed portions and protrusions of the fold enhancing roller unit 531 are used to perform sufficient fold enhancement on the fold of the printed material S is described. Here, the fold enhancing roller unit 531 is not limited to that shown in FIGS. 5 to 6B.

A structure of the fold enhancing roller unit 531 that differs from that described thus far is hereunder described.

Figure 7:
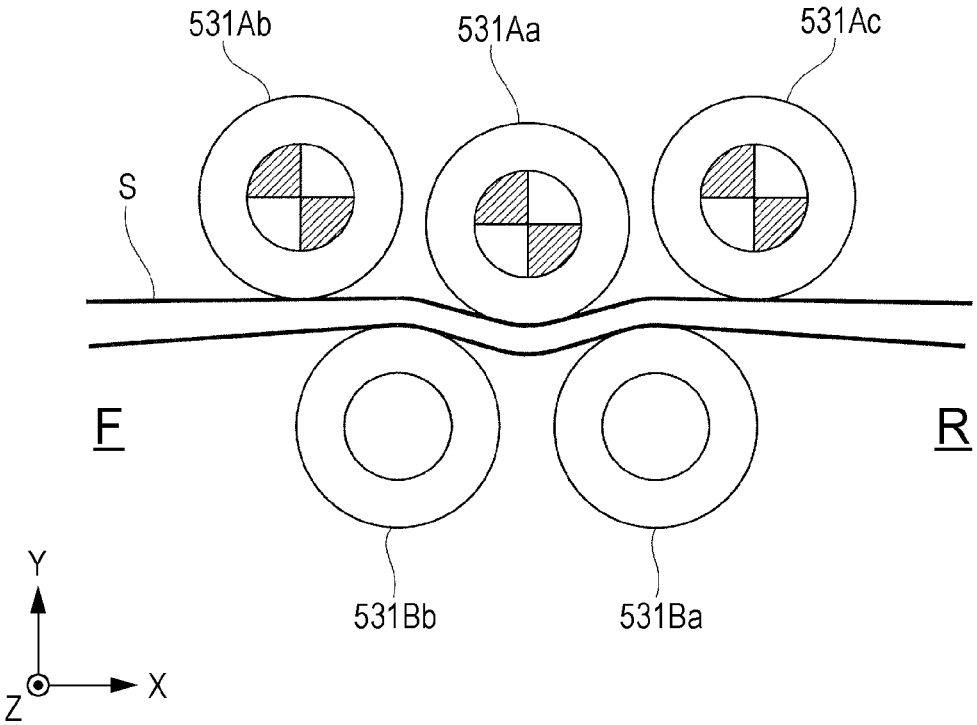
FIG. 7 illustrates another exemplary structure of the fold enhancing roller unit.

FIG. 7 illustrates another exemplary structure of the fold enhancing roller unit 531.

In the exemplary structure shown in FIG. 7, the upper roller 531A of the fold enhancing roller unit 531 includes an upper roller 531Aa, an upper roller 531Ab, and an upper roller 531Ac. The upper roller 531Ab is provided closer to the front F than the upper roller 531Aa. The upper roller 531Ac is provided closer to the rear R than the upper roller 531Aa. The lower roller 531B of the fold enhancing roller unit 531 includes a lower roller 531Ba and a lower roller 531Bb. The lower roller 531Ba is provided closer to the rear R than the upper roller 531Aa. The lower roller 531Bb is provided closer to the front F than the lower roller 531Ba.

The upper roller 531Aa protrudes downward with respect to the upper roller 531Ab and the upper roller 531Ac, and is supported by the upper supporting unit 534A. On the other hand, the upper roller 531Ab and the upper roller 531Ac are supported at the same height. The lower roller 531Ba and the lower roller 531Bb are supported at the same height by the lower supporting unit 534B.

The lower roller 531Ba is provided between the upper roller 531Aa and the upper roller 531Ac in the directions of movement of the fold enhancing functional unit 530 (that is, the directions X and −X). The lower roller 531Bb is provided between the upper roller 531Aa and the upper roller 531Ab in the directions of movement of the fold enhancing functional unit 530.

In this structure, in the upper roller 531A, the upper roller 531Aa forms a protrusion, with a gap formed between the upper roller 531Aa and the upper roller 531Ab and a gap formed between the upper roller 531Aa and the upper roller 531Ac forming recessed portions. In the lower roller 531B, the lower roller 531Ba and the lower roller 531Bb form protrusions, with a gap formed between the lower roller 531Ba and the lower roller 531Bb forming a recessed portion.

In performing fold enhancement on the fold of the printed material S, the gap that forms a recessed portion and that is formed between the upper roller 531Aa and the upper roller 531Ac engages with the lower roller 531Ba, which forms a protrusion; and the gap that forms a recessed portion and that is formed between the upper roller 531Aa and the upper roller 531Ab engages with the lower roller 531Bb, which forms a protrusion. In addition, the gap that forms a recessed portion and that is formed between the lower roller 531Ba and the lower roller 531Bb engages with the upper roller 531Aa, which forms a protrusion.

According to this structure, the printed material S is wound upon the protrusion of the upper roller 531Aa, the protrusion of the lower roller 531Ba, and the protrusion of the lower roller 531Bb. In this state, the fold enhancing functional unit 530 moves along the direction in which the fold of the printed material S is formed, so that the fold of the printed material S is drawn through the fold enhancing roller unit 531 and is capable of being subjected to sufficient fold enhancement. Since all of the recessed portions are deeply formed by the gaps between the corresponding rollers, the recessed portions and protrusion of the upper roller 531A and the lower roller 531B engage deeply with each other, so that stronger fold enhancement is performed on the fold of the printed material S.

An exemplary structure of the fold enhancing roller unit 531 that differs from those illustrated in FIGS. 5 to 7 is hereunder described.

Figure 8:
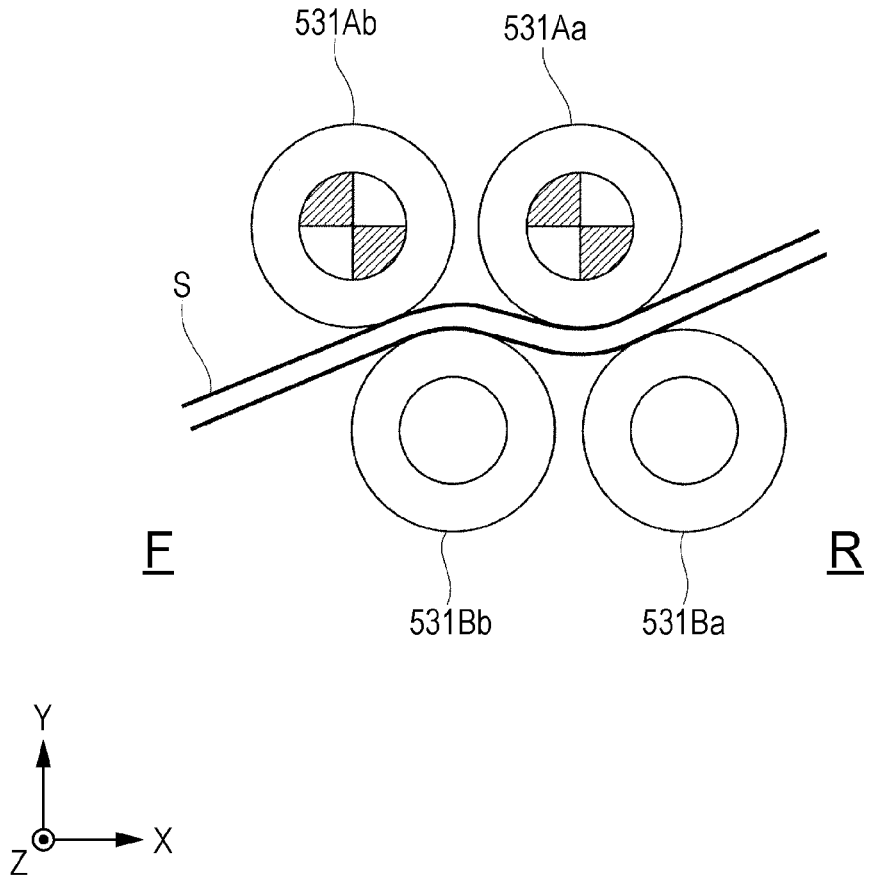
FIG. 8 illustrates still another exemplary structure of the fold enhancing roller unit.

FIG. 8 illustrates another exemplary structure of the fold enhancing roller unit 531.

In the exemplary structure shown in FIG. 8, the upper roller 531A of the fold enhancing roller unit 531 includes an upper roller 531Aa and an upper roller 531Ab. The upper roller 531Ab is provided closer to the front F than the upper roller 531Aa. The lower roller 531B of the fold enhancing roller unit 531 includes a lower roller 531Ba and a lower roller 531Bb. The lower roller 531Ba is provided closer to the rear R than the upper roller 531Aa. The lower roller 531Bb is provided closer to the front F than the lower roller 531Ba.

The upper roller 531Aa and the upper roller 531Ab are supported at the same height by the upper supporting unit 534A. The lower roller 531Ba and the lower roller 531Bb are supported at the same height by the lower supporting unit 534B. The lower roller 531Bb is provided between the upper roller 531Aa and the upper roller 531Ab in the directions of movement of the fold enhancing functional unit 530 (that is, the directions X and −X).

In this structure, in the upper roller 531A, the upper roller 531Aa forms a protrusion, with a gap formed between the upper roller 531Aa and the upper roller 531Ab forming a recessed portion. In the lower roller 531B, the lower roller 531Bb forms a protrusion, with a gap formed between the lower roller 531Ba and the lower roller 531Bb forming a recessed portion.

In performing fold enhancement on the fold of the printed material S, the gap that forms a recessed portion and that is formed between the upper roller 531Aa and the upper roller 531Ab engages with the lower roller 531Bb, which forms a protrusion. The gap that forms a recessed portion and that is formed between the lower roller 531Ba and the lower roller 531Bb engages with the upper roller 531Aa, which forms a protrusion.

According to this structure, the printed material S is wound upon the protrusion of the upper roller 531Aa and the protrusion of the lower roller 531Bb. In this state, the fold enhancing functional unit 530 moves along the direction in which the fold of the printed material S is formed, so that the fold of the printed material S is drawn through the fold enhancing roller unit 531 and is capable of being subjected to sufficient fold enhancement. The upper roller 531A and the lower roller 531B each include two rollers, so that the fold enhancement is performed by a simpler structure.

Next, an exemplary structure of the fold enhancing roller unit 531 that differs from those illustrated in FIGS. 5 to 8 is hereunder described.

Figure 9:
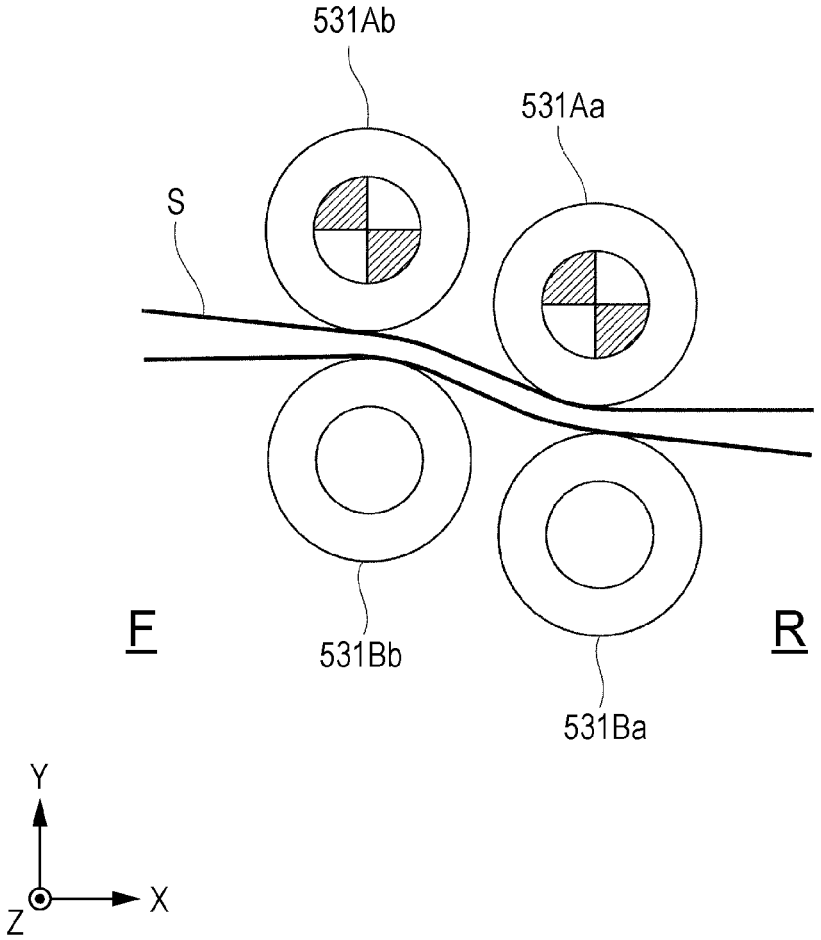
FIG. 9 illustrates still another exemplary structure of the fold enhancing roller unit.

FIG. 9 illustrates still another exemplary structure of the fold enhancing roller unit 531.

In the exemplary structure shown in FIG. 9, the upper roller 531A of the fold enhancing roller unit 531 includes an upper roller 531Aa and an upper roller 531Ab. The upper roller 531Ab is provided closer to the front F than the upper roller 531Aa. The lower roller 531B of the fold enhancing roller unit 531 includes a lower roller 531Ba and a lower roller 531Bb. The lower roller 531Bb is provided closer to the front F than the lower roller 531Ba.

The upper roller 531Aa is supported by the upper supporting unit 534A so as to protrude downward with respect to the upper roller 531Ab. The lower roller 531Bb is supported by the lower supporting unit 534B so as to protrude upward with respect to the lower roller 531Ba. The upper roller 531Aa and the lower roller 531Ba are provided such that their positions in the directions of movement of the fold enhancing functional unit 530 (that is, the directions X and −X) are aligned with each other. The upper roller 531Ab and the lower roller 531Bb are provided such that their positions in the directions of movement of the fold enhancing functional unit 530 are aligned with each other.

In this structure, in the upper roller 531A, the upper roller 531Aa forms a protrusion, and the upper roller 531Ab forms a recessed portion. In the lower roller 531B, the lower roller 531Bb forms a protrusion, and the lower roller 531Ba forms a recessed portion.

In performing fold enhancement on the fold of the printed material S, the upper roller 531Ab, which forms a recessed portion, and the lower roller 531Bb, which forms a protrusion, engage with each other. In addition, the lower roller 531Ba, which forms a recessed portion, and the upper roller 531Aa, which forms a protrusion, engage with each other.

According to this structure, the printed material S is wound upon the protrusion of the roller 531Aa and the protrusion of the lower roller 531Bb. In this state, the fold enhancing functional unit 530 moves along the direction in which the fold of the printed material S is formed, so that the fold of the printed material S is drawn through the fold enhancing roller unit 531 and is capable of being subjected to sufficient fold enhancement. The upper roller 531A and the lower roller 531B each include two rollers, so that the fold enhancement is performed by a simpler structure.

In the exemplary embodiment, the upper roller 531A of the fold enhancing roller unit 531 moves towards the lower roller 531B to nip and press the fold of the printed material S, as a result of which fold enhancement is performed. However, fold enhancement may be performed on the fold of the printed material S by moving the lower roller 531B towards the upper roller 531A. In this case, the upper roller 531A is an exemplary supporting unit, and the lower roller 531B is an exemplary pressing unit. The cam 537 is connected to the lower supporting unit 534B, receives a push force from the movement path section 540 of the path guide unit 536, and causes the lower roller 531B to move towards the upper roller 531A via the lower supporting unit 534B.

The structure of the fold enhancing roller unit 531 is not limited to the structures described in the exemplary embodiment. Any structure in which a recessed portion and a protrusion formed at one surface and a recessed portion and a protrusion formed at the other surface engage with each other with a fold of printed material S being interposed therebetween, to perform fold enhancement on the fold of the printed material S may be used.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material fold enhancing device comprising:

a pressing unit that includes one or more recessed portions and one or more protrusions, the pressing unit pressing a fold of a recording material on which a folding operation has been performed;

a supporting unit that includes one or more recessed portions and one or more protrusions, the supporting unit supporting the fold of the recording material with the fold of the recording material being interposed between the pressing unit and the supporting unit; and a driving unit that, with the fold of the recording material being interposed between the pressing unit and the supporting unit, moves the pressing unit and the supporting unit along a direction in which the fold of the recording material is formed, wherein a portion of the fold of the recording material is interposed between the one or more recessed portions of the pressing unit and the one or more protrusions of the supporting unit, and another portion of the fold of the recording material is interposed between the one or more protrusions of the pressing unit and the one or more recessed portions of the supporting unit, and wherein a nip is formed between one of the one or more recessed portions of the pressing unit and a corresponding one of the one or more protrusions of the supporting unit, wherein the pressing unit includes a first pressing roller that forms the one or more protrusions, and the one or more recessed portions are formed adjacent to the first pressing roller, wherein the supporting unit includes a first supporting roller that forms the one or more protrusions, and the one or more recessed portions are formed adjacent to the first supporting roller, wherein the pressing unit further includes a second pressing roller that forms the one or more recessed portions, and wherein the supporting unit further includes a second supporting roller that forms the one or more recessed portions.

2. The recording material fold enhancing device according to claim 1, wherein the pressing unit further includes a third pressing roller that form the one or more recessed portions, and wherein the one or more recessed portions are formed between the first supporting roller and the second supporting roller.

3. The recording material fold enhancing device according to claim 1, wherein the pressing unit further includes a third pressing roller, the second pressing roller forming the one or more recessed portions between the second pressing roller and the first pressing roller, the third pressing roller forming the one or more recessed portions between the third pressing roller and the first pressing roller, and wherein the one or more recessed portions are formed between the first supporting roller and the second supporting roller.

4. A recording material fold enhancing device comprising:

a pressing unit that includes one or more recessed portions and one or more protrusions, the pressing unit pressing a fold of a recording material on which a folding operation has been performed;

a supporting unit that includes one or more recessed portions and one or more protrusions, the supporting unit supporting the fold of the recording material with the fold of the recording material being interposed between the pressing unit and the supporting unit; and a driving unit that, with the fold of the recording material being interposed between the pressing unit and the supporting unit, moves the pressing unit and the supporting unit along a direction in which the fold of the recording material is formed, wherein a portion of the fold of the recording material is interposed between the one or more recessed portions of the pressing unit and the one or more protrusions of the supporting unit, and another portion of the fold of the recording material is interposed between the one or more protrusions of the pressing unit and the one or more recessed portions of the supporting unit, and wherein a nip is formed between one of the one or more recessed portions of the pressing unit and a corresponding one of the one or more protrusions of the supporting unit, wherein the pressing unit includes a first pressing roller that forms the one or more protrusions, and the one or more recessed portions are formed adjacent to the first pressing roller, wherein the supporting unit includes a first supporting roller that forms the one or more protrusions, and the one or more recessed portions are formed adjacent to the first supporting roller, wherein the pressing unit further includes a second pressing roller that forms the one or more recessed portions between the second pressing roller and the first pressing roller, and wherein the supporting unit further includes a second supporting roller that forms the one or more recessed portions between the second supporting roller and the first supporting roller.

5. A recording material fold enhancing device comprising:

a first unit that includes one or more recessed portions and one or more protrusions, the first unit pressing a fold of a recording material on which a folding operation has been performed;

a second unit that includes two or more protrusions, the second unit supporting the fold of the recording material with the fold of the recording material being interposed between the first unit and the second unit; and a driving unit that, with the fold of the recording material being interposed between the first unit and the second unit, moves the first unit and the second unit along a direction in which the fold of the recording material is formed, wherein a portion of the fold of the recording material is interposed between the one or more recessed portions of the first unit and the one or more protrusions of the second unit, and wherein a nip is formed between at least one of the recessed portions of the first unit and one of the protrusions of the supporting unit, and no nip is formed between at least one of the protrusions of the first unit and the other one of the protrusions of the second unit.

* * * * *